US009321603B1

(12) United States Patent
Nakamura

(10) Patent No.: US 9,321,603 B1
(45) Date of Patent: Apr. 26, 2016

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Junichi Nakamura, Mishima (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/658,445

(22) Filed: Mar. 16, 2015

(51) Int. Cl.
*B65H 5/06* (2006.01)
*B65H 7/20* (2006.01)

(52) U.S. Cl.
CPC ..... *B65H 5/068* (2013.01); *B65H 5/062* (2013.01); *B65H 7/20* (2013.01); *B65H 2404/1441* (2013.01); *B65H 2404/1451* (2013.01)

(58) Field of Classification Search
CPC ..... B65H 5/062; B65H 5/068; B65H 2404/1441; B65H 2404/1451
See application file for complete search history.

(56) References Cited

U.S. PATENT DOCUMENTS 7,523,933 B2 * 4/2009 Linder et al. ..... B65H 5/062 271/272
2011/0049800 A1 * 3/2011 deJong ..... B65H 5/062 271/273

FOREIGN PATENT DOCUMENTS

JP 02018243 A * 1/1990

* cited by examiner

*Primary Examiner* — Luis A Gonzalez
(74) *Attorney, Agent, or Firm* — Amin, Turocy & Watson LLP; Gregory Turocy

(57) ABSTRACT

There is provided an image forming apparatus of an embodiment including a first roller, a second roller, a plurality of biasing members, a control section, and a driving section. The second roller is provided to face the first roller. The plurality of biasing members bias the second roller toward the first roller at different strengths respectively. The control section selects one biasing member of the plurality of biasing members. The driving section selectively drives the biasing member that is selected by the control section and makes the biasing member bias the second roller toward the first roller.

7 Claims, 7 Drawing Sheets

IMAGE FORMING APPARATUS

FIELD

Embodiments described herein relate generally to an image forming apparatus.

BACKGROUND

In the related art, wrinkles are generated when forming an image on a thick sheet material using a fixing device. In order to suppress generation of the wrinkles, a method of producing a low pressure by changing a position of a biasing member biasing a pressing roller with a cam and weakening a biasing force is known. However, in this method, it is difficult to stabilize the biasing member at a plurality of different positions. As a result, it is difficult to realize optimal pressure depending on the sheet materials having various thicknesses.

DETAILED DESCRIPTION

An image forming apparatus of an embodiment includes a first roller, a second roller, a plurality of biasing members, a control section, and a driving section. The second roller is provided to face the first roller. The plurality of biasing members bias the second roller toward the first roller at different strengths respectively. The control section selects one biasing member of the plurality of biasing members. The driving section selectively drives the biasing member that is selected by the control section and makes the biasing member bias the second roller toward the first roller.

Hereinafter, an image forming apparatus 1 of an embodiment will be described with reference to the drawings.

Figure 1:
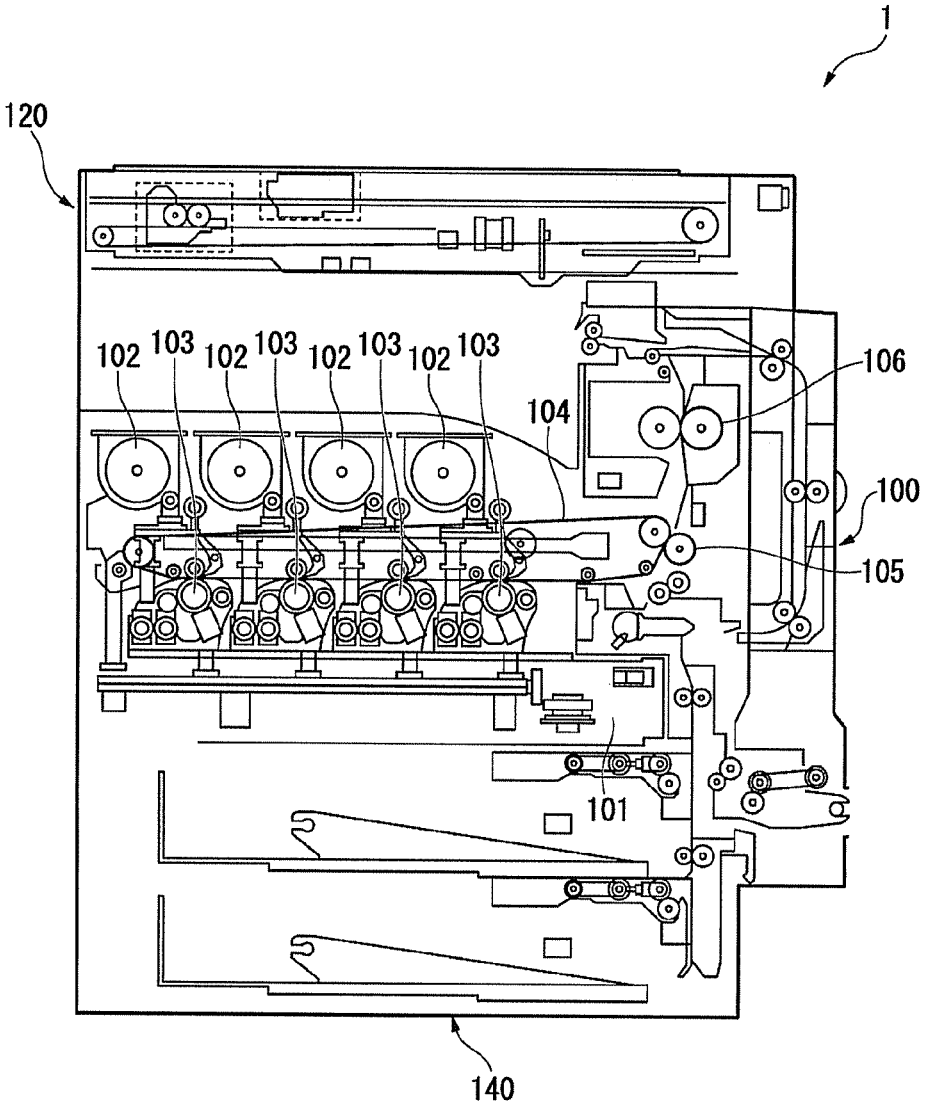
FIG. 1 is a perspective front view illustrating an entire configuration example of an image forming apparatus of an embodiment.

FIG. 1 is a perspective front view illustrating an entire configuration example of the image forming apparatus 1 of the embodiment.

Figure 5:
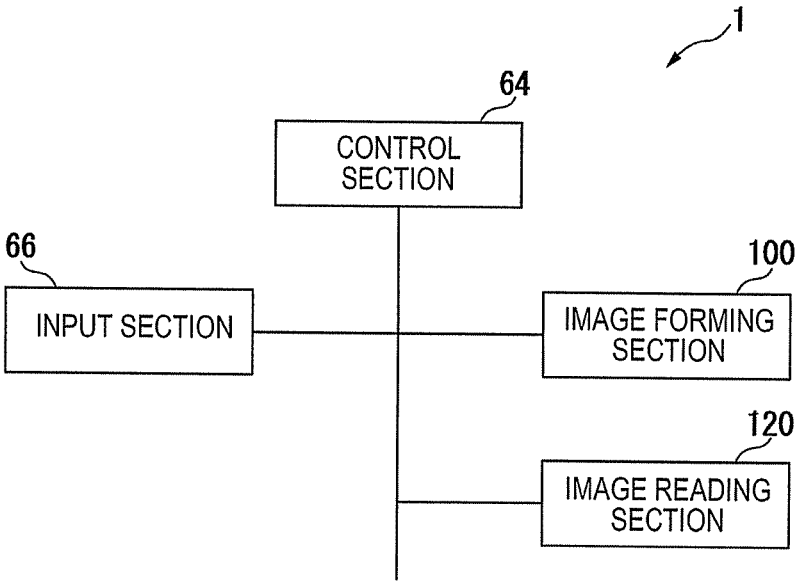
FIG. 5 is a conceptual diagram illustrating a configuration example of the image forming apparatus of the embodiment.

As illustrated in FIGS. 1 and 5, the image forming apparatus 1 includes an image forming section 100, an image reading section 120, a control section 64, and an input section 66.

The control section 64 is formed of a CPU, a ROM, and a RAM. As illustrated in FIG. 5, the control section 64 controls the image forming section 100, the image reading section 120, and the input section 66.

Information of a sheet material on which an image is formed is input into the input section 66. The information of the sheet material is a type of sheet material. For example, the input section 66 is a touch panel display.

The image reading section 120 reads image information of an object to be copied as brightness of light. The image reading section 120 generates data of the image formed on the sheet material by the image forming section 100 based on the read image information.

The image forming section 100 includes a sheet material storage section 140. The sheet material storage section 140 supplies the sheet material one by one to the image forming section 100 according to a timing of formation of an output image.

The image forming section 100 forms the output image on the sheet material based on the image data. The image data may be formed by the image reading section 120 or may be supplied from the outside. The image data supplied from the outside may be supplied through a network, or may be supplied by a storage medium connected to the image forming apparatus 1.

The image forming section 100 forms the image on the sheet material by toner based on the image data.

The image forming section 100 includes an exposure device 101, a plurality of toner cartridges 102, a plurality of single-color image forming sections 103, an intermediate transfer belt 104, a sheet transfer device 105, and a fixing device 106.

The exposure device 101 irradiates laser light and generates an electrostatic latent image. An intensity of the laser light irradiated by the exposure device 101 is set corresponding to the brightness of the image data of each color.

Each toner cartridge 102 supplies toner to the single-color image forming section 103. Toner colors supplied by each toner cartridge 102 are respectively yellow (Y), magenta (M), cyan (C), and black (K).

Each single-color image forming section 103 holds the electrostatic latent image generated by the laser light irradiated by the exposure device 101. The single-color image forming section 103 forms a toner image corresponding to the electrostatic latent image using the toner supplied by the toner cartridge 102. The single-color image forming section 103 transfers the toner image to the intermediate transfer belt 104.

The intermediate transfer belt 104 transports the toner image formed by the single-color image forming section 103.

The sheet transfer device 105 transfers the toner image transported by the intermediate transfer belt 104 onto a sheet material supplied from the sheet material storage section 140.

The fixing device 106 fixes the toner to the sheet material by applying heat and a pressure to the toner transferred onto a surface of the sheet material.

Figure 2:
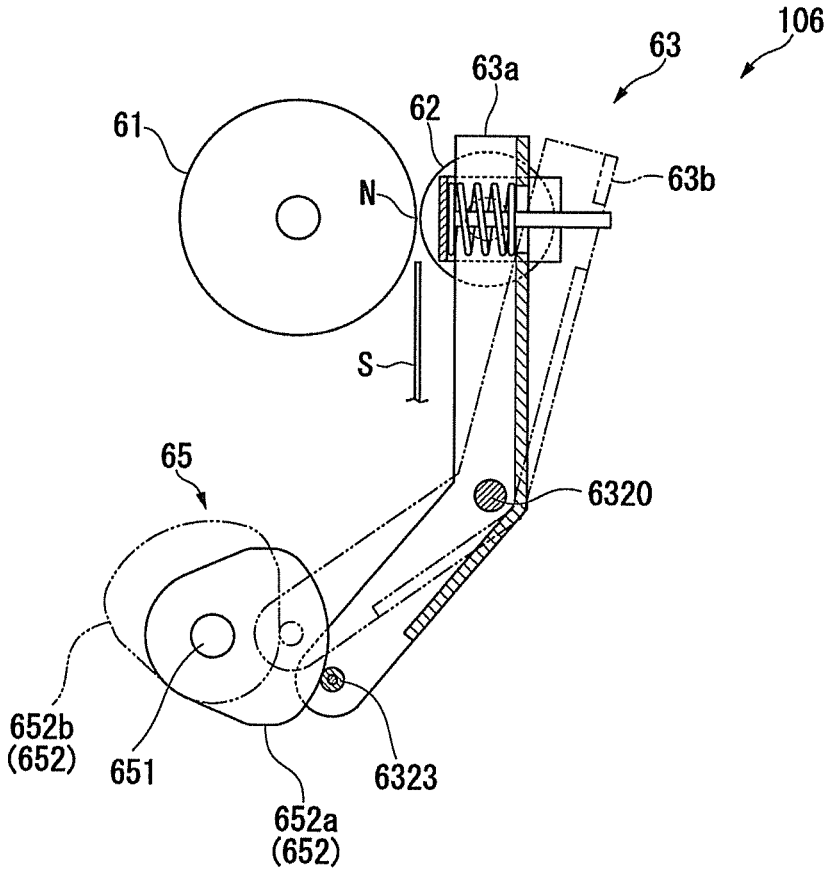
FIG. 2 is a side view illustrating a configuration example of a fixing device of the image forming apparatus of the embodiment.

Hereinafter, a configuration of the fixing device 106 will be described with reference to FIG. 2. FIG. 2 is a side view illustrating a configuration example of the fixing device 106 of the image forming section 100. Configuration elements 63*b* and 652*b* illustrated by dotted lines are positioned on the inside of configuration elements 63*a* and 652*a*, and a front side of a configuration element 62 illustrated by solid lines.

The fixing device 106 includes a first roller 61, a second roller 62, a biasing member 63, and a driving section 65. The fixing device 106 is controlled by the control section 64.

The first roller 61 is a heating roller. The first roller 61 has a heat source (not illustrated). The control section 64 performs control of the heat source to generate heat. A temperature of the heating roller increases to a temperature capable of fixing the toner formed on the sheet. The heating roller applies heat to the toner transferred onto the surface of the sheet material.

The second roller 62 is a pressing roller. The pressing roller is disposed to face the heating roller. The pressing roller is pressed to the heating roller by the biasing member 63. The pressing roller and the heating roller pressed by the biasing member 63 form a nip portion N. A sheet material S onto which the toner is transferred is inserted into the nip portion N. The toner transferred onto the surface of the sheet material S is fixed to the sheet material S by applying heat and pressure. Moreover, the fixing device 106 has a plurality of biasing members 63. A detailed description of the plurality of biasing members 63 will be given later.

The control section 64 receives information of the sheet material from the input section 66. The control section 64 selects one biasing member 63 of the plurality of biasing members 63 based on the received information of the sheet material. That is, the control section 64 selects the biasing member 63 biasing the second roller 62 depending on a type of sheet material input into the input section 66.

A plurality of types of sheet material includes a first type of sheet material and a second type of sheet material. The second type of sheet material is thicker than the first type of sheet material. The first type of sheet material is, for example, plain paper. The second type of sheet material is, for example, an envelope.

The plurality of biasing members 63 bias the second roller 62. The plurality of biasing members 63 includes a first biasing member 63*a* and a second biasing member 63*b*. A biasing force of the second biasing member 63*b* is weaker than a biasing force of the first biasing member 63*a*.

The control section 64 selects the biasing member 63 according to the type of sheet material input into the input section 66. When the first type of sheet material is input into the input section 66, the control section 64 selects the first biasing member 63*a*. When the second type of sheet material is input into the input section 66, the control section 64 selects the second biasing member 63*b*.

The driving section 65 selectively drives the biasing member 63 selected by the control section 64. The driving section 65 makes the biasing member 63 bias the second roller 62 to the first roller 61.

Figure 3:
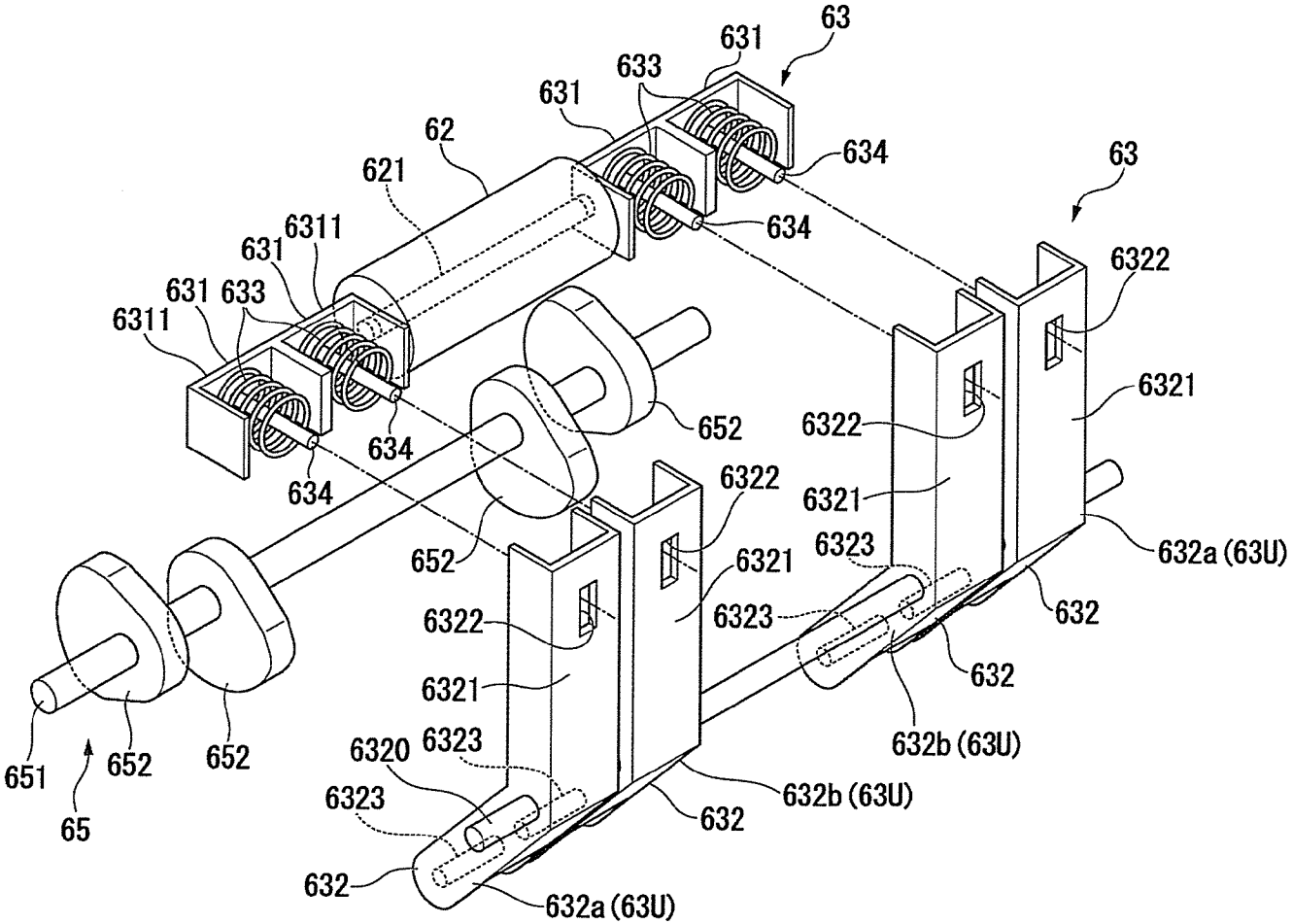
FIG. 3 is an exploded perspective view illustrating a configuration example of a biasing member and a driving section of the image forming apparatus of the embodiment.

Hereinafter, configurations of the biasing member 63 and the driving section 65 will be described with reference to FIG. 3. FIG. 3 is an exploded perspective view illustrating a configuration example of the biasing member 63 and the driving section 65 of the image forming section 100.

As illustrated in FIG. 3, the driving section 65 includes a cam shaft 651 and a plurality of cams 652. The cam shaft 651 is parallel to the second roller 62. The plurality of cams 652 are provided adjacent to each other in a longitudinal direction of the cam shaft 651 corresponding to the plurality of biasing members 63.

Each biasing member 63 includes a frame 631, an arm 632, and an elastic body 633.

The frame 631 serves a role to receive the biasing force applied from the arm 632. The frame 631 is fixed to a rotation shaft 621 of the second roller 62. The frame 631 has a surface 6311 parallel to the rotation shaft 621 of the second roller 62. The frame 631 has a support rod 634 for supporting the elastic body 633. The support rod 634 is provided on the surface 6311 so as to be vertical to the surface 6311 and not to intersect the rotation shaft 621.

The arm 632 swings around a support shaft 6320 parallel to the second roller 62. If the cam 652 pushes the other end of the arm 632 through a follower 6323, the other end of the arm 632 is displaced. Thus, the arm 632 swings.

The arm 632 has a surface 6321. The surface 6321 has a slit-shaped hole 6322 parallel in the longitudinal direction of the arm 632. The arm 632 is fitted to the frame 631 in a state where the support rod 634 passes through the hole 6322.

The elastic body 633 is provided between one end of the arm 632 and the frame 631. The elastic body 633 is elastically deformed by being sandwiched between one end of the arm 632 and the frame 631 when the arm 632 swings in a direction in which one end of the arm 632 becomes closer to the frame 631.

The elastic body 633 is, for example, a spring. The spring 633 is supported on the frame 631 in a state of being passed through in the support rod 634. One end of the spring 633 faces the surface 6311 side of the frame 631. The other end of the spring 633 faces the surface 6321 side of the arm 632.

The hole 6322 of the arm 632 is provided having a size such that the support rod 634 can pass through the hole 6322 but the spring 633 cannot pass therethrough. Thus, if the surface 6321 is close to the surface 6311, the spring 633 is pushed by the surface 6321 and then an elastic force is generated.

If the cam 652 pushes the other end of the arm 632 and the other end of the arm 632 is displaced, the surface 6321 is close to the surface 6311 of the frame 631. If an interval between the surface 6311 and the surface 6321 is a natural length of the spring 633 or less, the elastic force generated in the spring 633 acts on the surface 6311. As a result, the biasing force acts on the second roller 62.

Both ends of the spring 633 are fixed neither to the surface 6311 nor the surface 6321. Thus, if the interval between the surface 6311 and the surface 6321 is the natural length of the spring 633 or more, the biasing force does not act.

The plurality of biasing members 63 include the elastic bodies 633 having elastic coefficients different from each other. Thus, each biasing member 63 biases the second roller 62 to the first roller 61 at a different strength.

Each of the plurality of biasing members 63 includes a pair of biasing units 63U biasing one end portion and the other end portion of the rotation shaft of the second roller 62 to the first roller 61. Each of the pair of biasing units 63U includes the frame 631, the arm 632, and the elastic body 633.

A plurality of the cams 652 corresponding to the plurality of biasing units 63U biasing one end portion of the rotation shaft of the second roller 62 are integrally provided at one end portion of the cam shaft 651.

A plurality of the cams 652 corresponding to the plurality of biasing units 63U biasing the other end portion of the rotation shaft of the second roller 62 are integrally provided at the other end portion of the cam shaft 651.

A cam 652*a* corresponding to an arm 632*a* and a cam 652*b* corresponding to an arm 632*b* are integrally provided having different phases from each other in a rotation direction around the shaft 651.

Figure 4A:
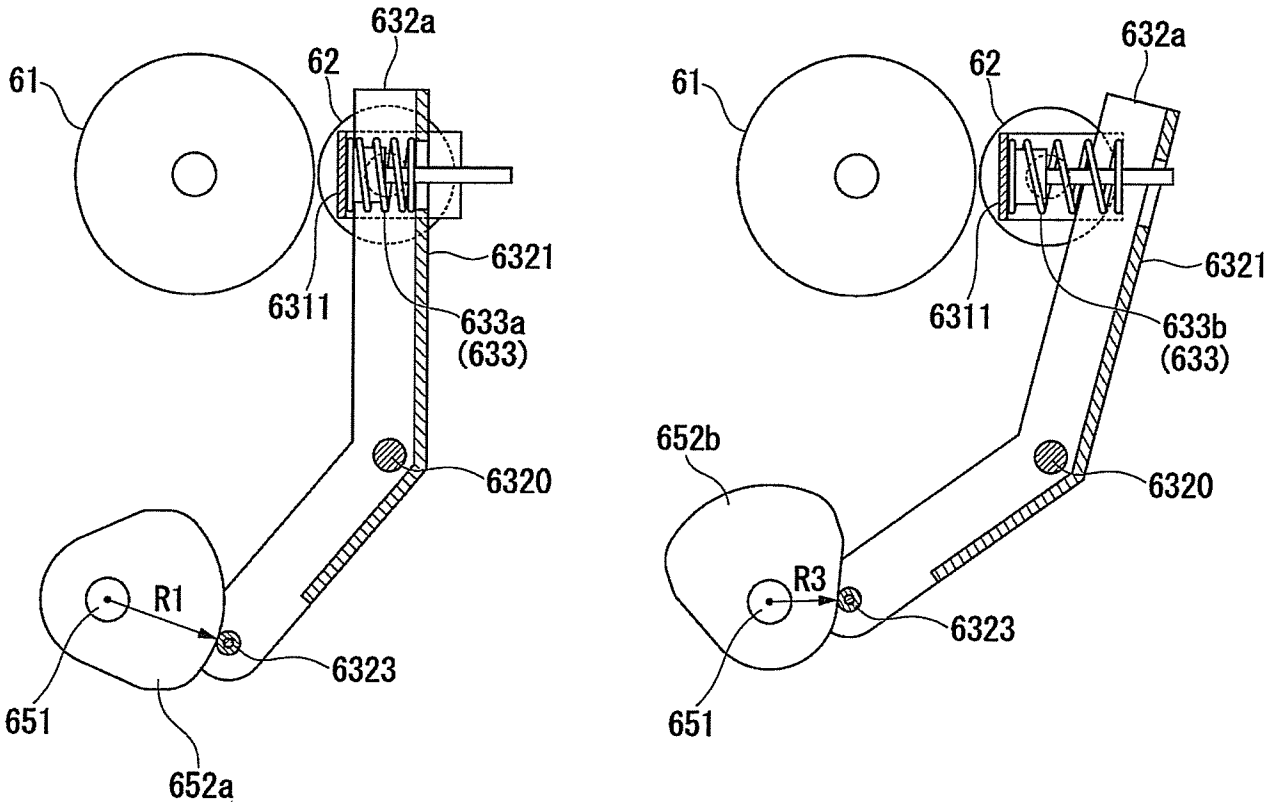
FIGS. 4A, 4B, and 4C are schematic views illustrating an operation of the biasing member and the driving section of the image forming apparatus of the embodiment.
Figure 4B:
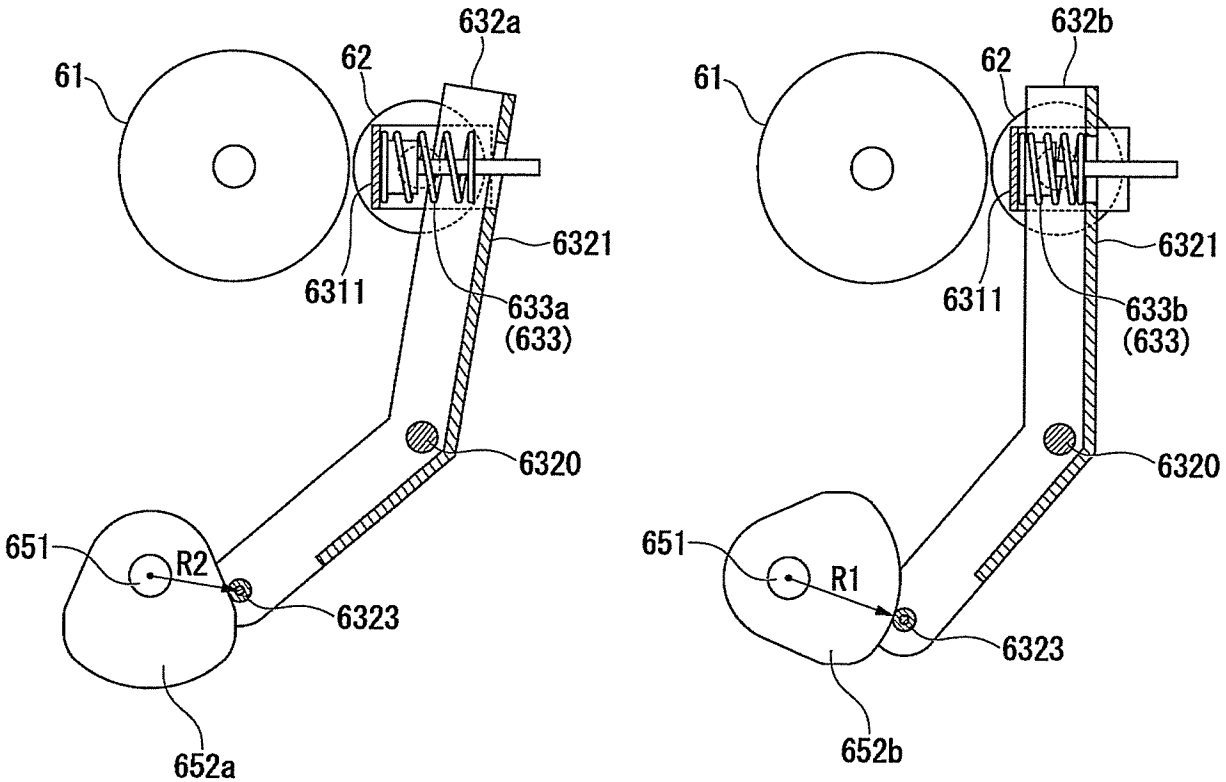
Figure 4C:
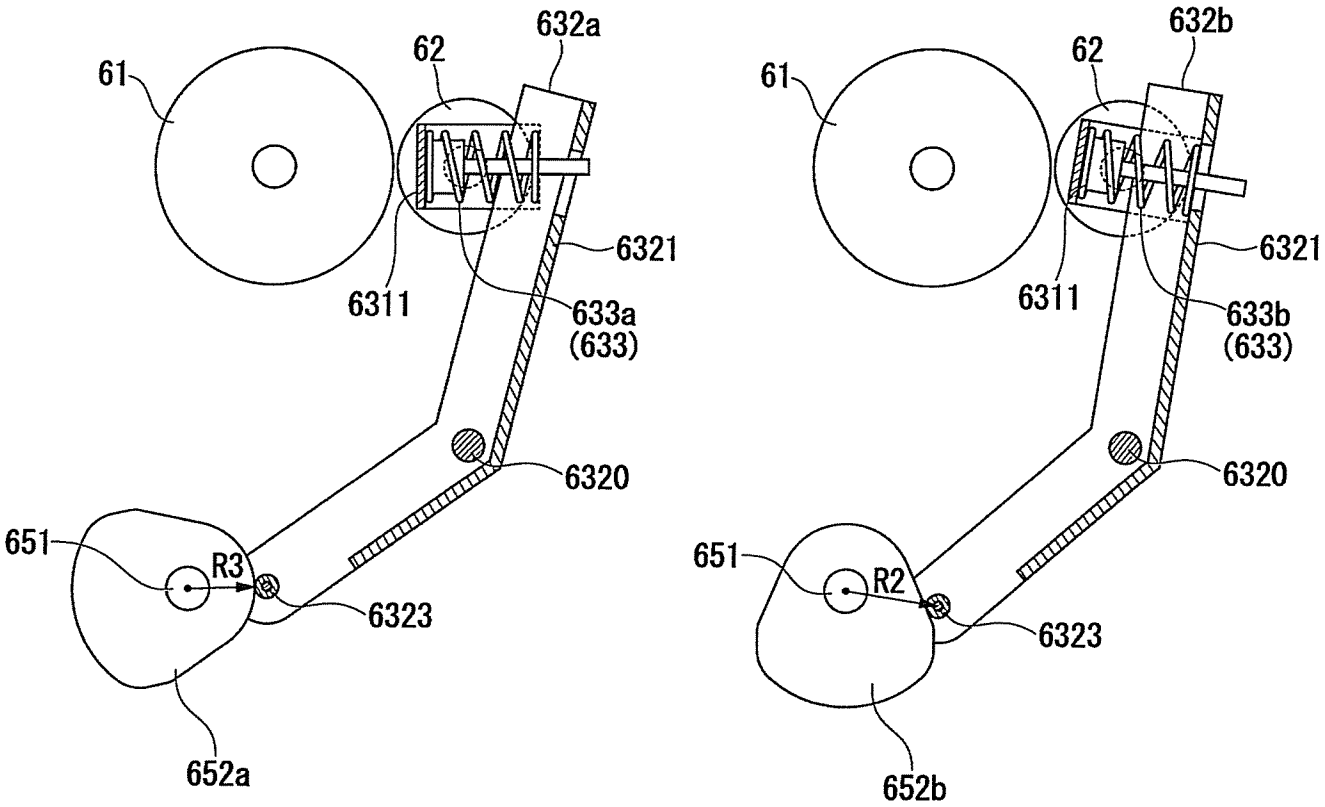

Hereinafter, operations of the biasing member 63 and the driving section 65 will be described with reference to FIGS. 4A, 4B, and 4C. FIGS. 4A, 4B, and 4C are schematic views illustrating the operations of the biasing member 63 and the driving section 65 of the image forming apparatus 1.

The arm 632*a* and the arm 632*b* have the same shape. In addition, the cam 652*a* and the cam 652*b* have the same shape. Specifically, as a distance R from a center of the rotation shaft 651 to a point coming into contact with the follower 6323 of the arm 632 has three types of length: R=R1, R2, and R3.

Here, R1>R2>R3. If R=R1, the surface 6321 of the arm 632 is closest to the surface 6311 of the frame 631. If R=R3, the surface 6321 of the arm 632 is furthest from the surface 6311 of the frame 631.

The phases of the cam 652*a* and the cam 652*b* are integrally provided being different from each other as described above. Specifically, if the distance R described above corresponding to each of the cams 652*a* and 652*b* is expressed as Ra and Rb, the phases of the cam 652*a* and the cam 652*b* are shifted so that it is possible to realize the following states.

A state (a) of Ra=R1 and Rb=R3 (see FIG. 4A)

A state (b) of Ra=R2 and Rb=R1 (see FIG. 4B)

A state (c) of Ra=R3 and Rb=R2 (see FIG. 4C)

A spring 633*b* (633) corresponding to the arm 632*b* has an elastic coefficient smaller than that of a spring 633*a* (633) corresponding to the arm 632*a*. The arm 632*a* presses the second roller 62 when performing printing on plain paper. The arm 632*b* presses the second roller 62 when performing printing on a thick paper (for example, envelope).

The natural length of the spring 633*a* is shorter than the distance between the surface 6311 and the surface 6321 if R=R2. The natural length of the spring 633*b* is longer than the distance between the surface 6311 and the surface 6321 if R=R2 and is shorter than the distance between the surface 6311 and the surface 6321 if R=R3.

The biasing force of each state becomes as follows by setting the arm, the cam, and the spring as described above.

In the state (a), the arm 632*a* is biased with a force F1 and the arm 632*b* is not biased (see FIG. 4A).

In the state (b), the arm 632*a* is not biased and the arm 632*b* is biased with a force F2 (see FIG. 4B).

In the state (c), the arm 632*a* is not biased and the arm 632*b* is biased with a force F3 (see FIG. 4C).

Here, F1>F2>F3.

The cam 652*b* can rotate slightly from the state of FIG. 4B. Thus, it is possible to increase or decrease the biasing force by a small value ΔF2 by finely adjusting the position of the arm 632*b* (F2→F2±ΔF2). The cam 652*b* can rotate slightly from the state of FIG. 4C. Thus, it is possible to increase or decrease the biasing force by a small value ΔF3 by finely adjusting the position of the arm 632*b* (F3→F3±ΔF3).

Thus, as described above, it is possible to realize an optimal biasing force in the vicinity of the values F2 and F3 of a plurality of biasing forces with respect to the thick paper more than the plain paper. Moreover, in a state where the biasing member for plain paper having a large elastic coefficient is not biased, since the biasing member dedicated for thick paper having a small elastic coefficient is used, it is possible to hold the pressure with high accuracy.

Since the image forming apparatus 1 of the embodiment described above has the plurality of biasing members 63 biasing the second roller 62 to the first roller 61 with different strengths respectively, it is possible to realize a plurality of biasing forces.

Since the control section 64 selecting the biasing member 63 biasing the second roller 62 depending on the type of sheet material S input into the input section 66 is provided, it is possible to select a state suitable for the thickness of the sheet material S among the plurality of biasing forces.

The elastic body 633 of the embodiment described above is the spring, but is not limited to the embodiment. For example, a member such as rubber or a piston can be used as the elastic body 633.

According to at least one of the embodiments described above, since the biasing member 63 biasing the second roller 62 to the first roller 61 with different strengths respectively is provided, it is possible to realize a plurality of biasing forces.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. An image forming apparatus comprising:

a first roller;

a second roller facing the first roller;

a plurality of biasing members that bias the second roller toward the first roller at different strengths respectively;

a control section that selects one biasing member of the plurality of biasing members;

a driving section that selectively drives the biasing member that is selected by the control section and makes the biasing member bias the second roller toward the first roller; and an input section that inputs a type of sheet material passing through between the first roller and the second roller, wherein the control section selects the biasing member biasing the second roller depending on the type of sheet material input into the input section, wherein the control section selects a first biasing member as the biasing member biasing the second roller if the type of sheet material input into the input section is a first type of sheet material, and selects a second biasing member having a biasing force weaker than that of the first biasing member as the biasing member biasing the second roller if the type of sheet material input into the input section is a second type of sheet material that is thicker than the first type of sheet material, and wherein the plurality of biasing members respectively include a frame that is fixed to a rotation shaft of the second roller, an arm that swings around a support shaft parallel to the second roller, and an elastic body that is provided between one end of the arm and the frame and is elastically deformed by being sandwiched between one end of the arm and the frame when the arm swings in a direction in which one end of the arm is close to the frame.

2. The apparatus according to claim 1, wherein the plurality of biasing members include elastic bodies having different elastic coefficients from each other.

3. The apparatus according to claim 1, wherein the driving section includes a cam shaft parallel to the second roller and a plurality of cams provided adjacent to each other in a longitudinal direction of the cam shaft corresponding to the plurality of biasing members, and wherein the cam corresponding to the biasing member presses the other end of the cam through a follower and displaces the other end of the arm, and thereby the arm that is included in each of the plurality of biasing members swings.

4. The apparatus according to claim 3, wherein the control section selects the biasing member biasing the second roller toward the first roller by controlling a rotational amount of the cam shaft.

5. The apparatus according to claim 4, wherein the control section controls the biasing force with which the biasing member biases the second roller toward the first roller by controlling the rotational amount of the cam shaft.

6. The apparatus according to claim 1, wherein each of the plurality of biasing members includes a pair of biasing units that bias one end portion and the other end portion of the rotation shaft of the second roller toward the first roller, and each of the pair of biasing units includes the frame, the arm, and the elastic body.

7. The apparatus according to claim 6, wherein the plurality of cams corresponding to the plurality of biasing units biasing one end portion of the rotation shaft of the second roller are integrally provided at one end portion of the cam shaft, and wherein the plurality of cams corresponding to the plurality of biasing units biasing the other end portion of the rotation shaft of the second roller are integrally provided at the other end portion of the cam shaft.

* * * * *